US010226655B2

(12) United States Patent
Dwyer et al.

(10) Patent No.: US 10,226,655 B2
(45) Date of Patent: Mar. 12, 2019

(54) FIRE EXTINGUISHING DEVICE

(71) Applicants: Mary M. Dwyer, Haddonfield, NJ (US); Anushree Sreedhar, Edison, NJ (US)

(72) Inventors: Mary M. Dwyer, Haddonfield, NJ (US); Anushree Sreedhar, Edison, NJ (US)

( * ) Notice: Subject to any disclaimer, the term of this patent is extended or adjusted under 35 U.S.C. 154(b) by 162 days.

(21) Appl. No.: 15/416,087

(22) Filed: Jan. 26, 2017

(65) Prior Publication Data

US 2017/0216640 A1 Aug. 3, 2017

Related U.S. Application Data

(60) Provisional application No. 62/289,213, filed on Jan. 30, 2016.

(51) Int. Cl.

| | |
|---|---|
| ***A62C 13/02*** | (2006.01) |
| ***A62C 13/14*** | (2006.01) |
| ***A62C 19/00*** | (2006.01) |

(52) U.S. Cl.

CPC ..... *A62C 13/14* (2013.01); *A62C 13/02* (2013.01); *A62C 19/00* (2013.01)

(58) Field of Classification Search

CPC ..... A62C 13/003; A62C 13/02; A62C 13/14; A62C 13/20; A62C 13/74; A62C 19/00

See application file for complete search history.

(56) References Cited

U.S. PATENT DOCUMENTS

| | | | | |
|---|---|---|---|---|
| 3,727,840 A * | 4/1973 | Nigro | A61L 9/127 239/43 |
| 4,197,915 A * | 4/1980 | Martin | A62C 13/64 169/72 |
| 4,630,775 A * | 12/1986 | Mandon | A01M 1/2044 239/56 |
| 6,796,382 B2 * | 9/2004 | Kaimart | A62C 3/025 169/26 |

* cited by examiner

*Primary Examiner* — Ryan A Reis
(74) *Attorney, Agent, or Firm* — Burr Forman McNair

(57) ABSTRACT

An example fire extinguishing apparatus may include a housing comprising at least one escape hole, a first compartment within the housing containing a first extinguishant agent, and a second compartment within the housing containing a second extinguishant agent. The first compartment may be rotatable relative to the second compartment. The apparatus may further include a barrier disposed between the first compartment and the second compartment configured to separate the first extinguishant agent from the second extinguishant agent, and a barrier rupture mechanism. The barrier rupture mechanism may be configured to rupture the barrier in response to rotation of the first compartment relative to the second compartment to permit the first extinguishant agent to mix with the second extinguishant agent and cause a pressure generating reaction that forms an extinguishant mixture and forces the extinguishant mixture through the at least one escape hole of the housing.

20 Claims, 10 Drawing Sheets

FIRE EXTINGUISHING DEVICE

CROSS-REFERENCE TO RELATED APPLICATIONS

This application claims the benefit of U.S. Provisional Application No. 62/289,213 filed on Jan. 30, 2016, the entire contents of which are hereby incorporated herein by reference.

TECHNICAL FIELD

Example embodiments generally relate to safety equipment and, more particularly, relate to devices for extinguishing fires.

BACKGROUND

A standard residential fire extinguisher ("SFE") is a cylindrical pressurized vessel that can weigh up to 30 pounds and can be used to extinguish Class A, B, or C fires. In this regard, class A fires typically involve ordinary combustible materials, such as, cloth, wood, paper, plastics, and the like. Class B fires typically involve flammable or combustible liquids, such as, gasoline, alcohol, oil-based paints, and the like, and Class C fires typically involve energized electrical equipment.

SFEs can be activated by the P.A.S.S. method (designed by FEMA), which consists of Pulling a pin, Aiming at the base of the fire (aiming at flames is ineffective), Squeezing the lever slowly, and Sweeping from side to side. However, before utilizing the P.A.S.S. method, a user is encouraged to notify the authorities, evacuate all others from the area, and ensure that the type of fire extinguisher she is using addresses the class of fire that she is facing. This process can be neither time-efficient nor easy. It is generally recognized that the average household fire tends to double in size every 60 seconds (Grimwood, Paul. Euro Firefighter. Lindley, Huddersfield, West Yorkshire: Jeremy Mills, 2008. Print.).

In some instances, a user of an SFE may be at risk of further endangering her property, herself, and those around her by attempting to use an SFE, because use of the SFE often involves actively "fighting" the fire. The average person (i.e., not a trained first responder) does not have basic training in the activation of an SFE, knowledge of its optimal use (i.e., which extinguishant classes address which fires, the correct distance at which the extinguishants are effective), or necessarily easy access to the SFE that she keeps in her home (i.e., many residences hold SFEs in the kitchen or garage, but the deadliest fires take place in the bedroom and living room)(reference National Fire Protection Association's Fire Analysis and Research Division's release of the Home Structure Fires analysis in April 2013).

Prior to the development and widespread use of SFEs, fire extinguishing balls were commonly used in the home. In some instances, fire extinguisher balls were generally considered useful and relatively safe because operation was rather intuitive. However, prior fire extinguisher balls have nonetheless suffered from various detrimental features, from safety, ease of use, and efficacy perspectives, and therefore improvements in the area of fire extinguishing ball technology is desirable.

BRIEF SUMMARY OF SOME EXAMPLES

Accordingly, various example embodiments of the present inventions are directed to fire extinguisher devices that are safer, easier to use, and more effective. Some example embodiments are fire extinguisher balls that include features and extinguishants that are safer, easier to use, and more effective than conventional devices.

An example fire extinguishing apparatus may include a housing comprising at least one escape hole, a first compartment within the housing containing a first extinguishant agent, and a second compartment within the housing containing a second extinguishant agent. The first compartment may be rotatable relative to the second compartment. The apparatus may further include a barrier disposed between the first compartment and the second compartment configured to separate the first extinguishant agent from the second extinguishant agent, and a barrier rupture mechanism. The barrier rupture mechanism may be configured to rupture the barrier in response to rotation of the first compartment relative to the second compartment to permit the first extinguishant agent to mix with the second extinguishant agent and cause a pressure generating reaction that forms an extinguishant mixture and forces the extinguishant mixture through the at least one escape hole of the housing.

An example method may comprise rotating a first housing portion of a fire extinguisher apparatus relative to a second housing portion of the fire extinguisher apparatus, and causing, via the rotating, a blade to cut a seal of a barrier between a first compartment containing a first extinguishant agent and a second compartment containing a second extinguishant agent. The example method may further comprise mixing, in response to cutting the seal, the first extinguishant agent with the second extinguishant agent to cause a pressure generating reaction that forms an extinguishant mixture and forces the extinguishant mixture through the at least one escape hole of the fire extinguisher apparatus housing.

Another example fire extinguisher apparatus may be provided. The fire extinguisher apparatus may include a housing comprising at least one escape hole, a first compartment within the housing containing a first extinguishant agent, and a second compartment within the housing containing a second extinguishant agent. The first compartment may be rotatable relative to the second compartment. The apparatus may further include a barrier disposed between the first compartment and the second compartment configured to separate the first extinguishant agent from the second extinguishant agent, and a barrier rupture mechanism. The barrier rupture mechanism may be configured to rupture the barrier in response to rotation of the first compartment relative to the second compartment to permit the first extinguishant agent to mix with the second extinguishant agent and cause a pressure generating reaction that forms an extinguishant mixture and forces the extinguishant mixture through the at least one escape hole of the housing. The barrier may comprise a seal, and the barrier rupture mechanism may comprise a blade that rotates with the first compartment to cut the seal. The barrier may further comprise a plate and a ramp. The barrier rupture mechanism may also include a protrusion that engages the ramp to force the plate into an increasingly open position between the first compartment and the second compartment as the first compartment rotates relative to the second compartment. The ramp may be disposed on the plate at a location such that the blade cuts a portion of the seal prior to the protrusion engaging the ramp.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
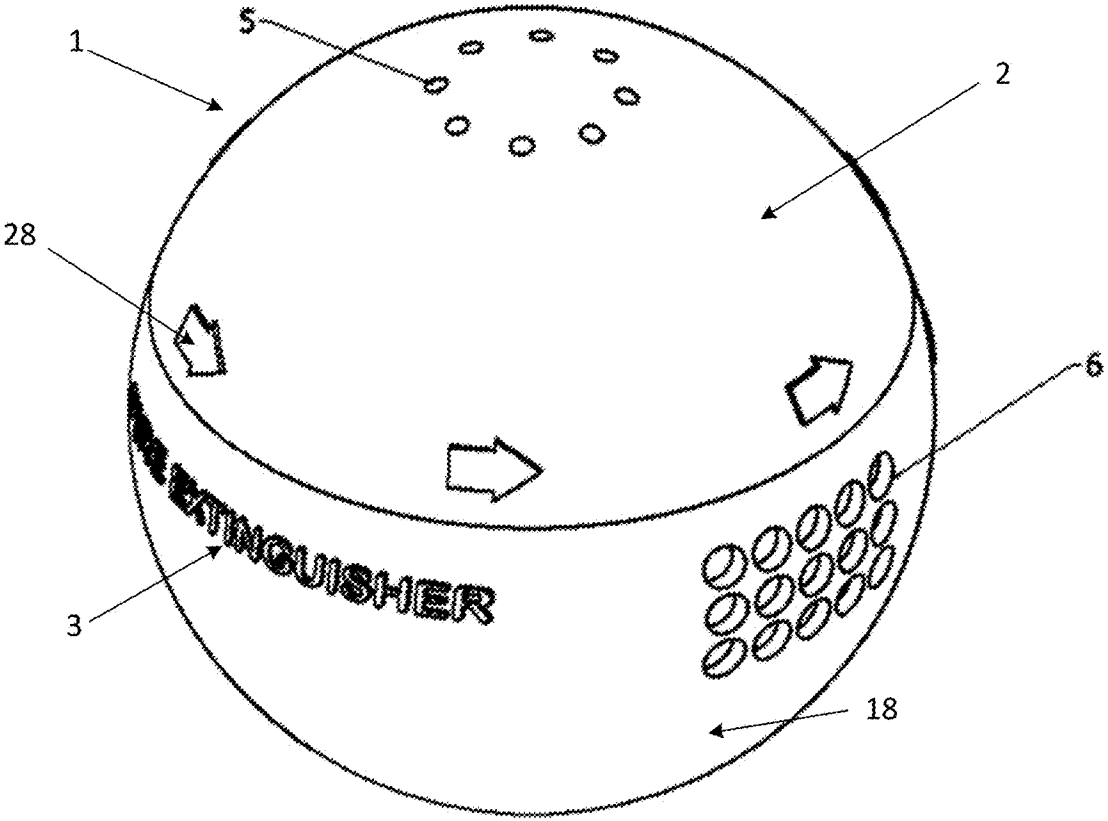
FIG. 1 illustrates a perspective front view of a fire extinguishing apparatus according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout.

Example embodiments relate to fire extinguishers and, according to some example embodiments, to a small, fire extinguishing ball that a user tosses, aims, or places at the base of a small fire to extinguish the fire at its start.

While the following description often refers to an example embodiment in the form of an example fire extinguisher ball, one of skill in the art would appreciate that this is merely one example embodiment based on the underlying inventions described herein. In this regard, an example fire extinguishing apparatus, possibly in the form of a ball, may be primarily intended for use in residences and, because of its aesthetic, may be integrated into any area of the house in which a fire may occur (e.g. bedroom, living room, dining room, trash cans). In particular, the size (e.g., the size of a softball) and appearance of the extinguisher may encourage the user to keep a number (e.g., a half dozen) of the example fire extinguisher balls stacked in, for example, a decorative bowl. Therefore, if the user fails to extinguish the fire through application of a first ball, she can easily employ additional balls.

As the design, according to some example embodiments, encourages the homeowner to strategically deploy the example lightweight fire extinguishing balls in widely separated parts of the home, the homeowner can have ready access to the fire extinguishing balls whenever a fire starts. Further, according to some example embodiments, the extinguisher ball can be easy to use, since use is based on intuitive actions, such as, of throwing a ball, rolling a ball, or aiming a stream of foam. Unlike some conventional fire extinguishers, some example embodiments need not require maintenance because the extinguishants may have a relatively long shelf-life.

An example embodiment may take the form of a small, attractive fire extinguishing ball that does not require maintenance, is twist-activated, and has the capacity to extinguish a small fire or prevent a small fire from spreading. The example ball may provide a person with a time-efficient aid in the presence of a starting fire and provide the user with the confidence to abandon the fire she addressed to seek help (e.g., call 911), gather her loved ones, or find an additional means to assist with putting out the fire, if necessary. This can mitigate the panic and time-waste that can occur in the critical event of a fire, which can quickly escalate if not dealt with promptly.

In some example embodiments, the example fire extinguisher apparatus may comprise two hemispheres (or portions of a sphere) that are joined together to form a sphere or a portion of a sphere. The hemispheres may be snap-fit such that they are inseparable but still rotatable. The rotation of the hemispheres relative to one another can rupture a barrier sealing two compartments within the apparatus, enabling the contents of one compartment to enter the other, mix, and react. The reaction can create pressure, which enables further mixing, and leads to creation of a mixture in the form of, for example, a fire extinguishing foam. The foam may be dispersed from an opening or hole in one of the hemispheres. Once activated, the example ball may be tossed, rolled, or placed at the base of a small fire. Alternatively, a stream of foam generated by the pressure in the example apparatus may be aimed at the base of a small fire. In this regard, if a user is not comfortable with throwing the ball, she can alternatively hold the extinguisher in her hand and aim the stream of fire extinguishing foam in the direction of the fire. The variability and simplicity of the user experience can result in the example apparatus being relatively versatile and easy to use.

One advantage of some example embodiments is that the fire extinguisher apparatus be easy to use. A user may simply twist the example fire extinguishing apparatus to activate it, then toss, roll, or place the apparatus at the base of the fire. Alternatively, the user may aim stream of foam at the base of the fire. The twist for activation may be a physical action that requires enough forethought and strength to prevent accidental activation, for example, by a young child, by dropping of the ball, or the like. However, the motion of twisting is neither difficult nor requires substantial training, so the average person in a state of panic could easily execute it. Therefore, users, such as older children, adults, elderly individuals, males, or females which can supply the sufficient number of foot-pounds of torque to rotate, for example, the opposing portions of the apparatus' housing (e.g., the hemispheres) may rupture a barrier and activate the fire extinguisher apparatus.

Additionally, the components of the extinguishant may be safe materials (e.g., baking soda and vinegar) that are non-hazardous to the health of the users, including young children, pets, or the like that may be present in a home. Furthermore, according to some example embodiments, no ongoing maintenance may be required. In this regard, some example extinguishants (e.g., baking soda and vinegar) can have relatively long shelf-lives and the compartments within which the extinguishments are held may be sealed and air-tight. Therefore, some example embodiments can be activated without concern about deterioration of the internal conditions.

When used, according to some example embodiments, a fire extinguishing mixture, for example, in the form of a foam, can escape through one or more multiple holes in the housing, such as, for example, holes in an upper housing portion. The holes may have hole coverings, which may be in the form of, for example, a coating, a wax, cellophane, shrink wrap, or the like, that can rupture, burst or breach from the pressure generated from the chemical reaction that occurs when the fire extinguisher apparatus is activated. In another embodiment, the foam may escape through a spray nozzle (e.g., McMaster High-Volume Clog-Resistant Spray Nozzle 3282K161) that may enable a wide range of dispersal under the pressure internal to the housing after activation. Moreover, use of a nozzle can be an additional protection against accidental activation since the nozzle can require a threshold pressure value before releasing the contents, which may require activation to create, in order to disperse the foam.

According to some example embodiments, the example fire extinguisher apparatus may include two separate compartments (or chambers). If the extinguishant mixture is made from a combination of acetic acid in the form of vinegar and sodium bicarbonate in the form of baking soda, one compartment may contain the vinegar and the other compartment may contain the baking soda. When activated, a barrier between the compartments may be ruptured or removed and the vinegar and baking soda may combine to form a fire extinguishing foam that creates pressure within the fire extinguisher apparatus, thereby causing the foam to exit the apparatus through one or more holes or openings in the housing. To further enhance the capacity of some example embodiments, a third compartment may be included in which dry chemical extinguishants may be held. The pressure from the reaction between the extinguishants can provide the force necessary for the dry chemical extinguishants to escape from the openings in the housing along with the fire extinguishing foam.

In another example embodiment, the fire extinguisher apparatus may be formed in the shape of a sphere absent of two spherical caps, having planar faces on opposing poles. In another embodiment, the fire extinguisher is in the shape of a cube. Embodiments with planar sides, or facets, may inhibit rolling after the ball is tossed. On the face designated as the bottom face (on the hemisphere without the opening(s) for the escape of the stream of foam), there may be a weight to ensure that the ball remains upright during foam dispersal.

According to some example embodiments, the extinguishants may be separated from each other until activation occurs. A water and or air-tight barrier that separates the compartments until said barrier is ruptured during activation may be utilized. When, for example, hemispheres of an example fire extinguishing ball are rotated relative to one another, the barrier separating the compartments may be caused to rupture, thereby allowing the contents of the compartments to mix.

According to some example embodiments, rather than clockwise rotation of the hemispheres relative to each other, a counterclockwise rotation may be required of the user. A purpose of requiring counterclockwise rotation may be to act as a further child-lock or child safety function because counterclockwise movement may be counterintuitive to a child.

Some example embodiments may necessitate 360 degree rotation to rupture the barrier dividing the compartments. A nearly 360 degree cut around the barrier may be desirable because doing so can ensures that the barrier does not obstruct the escape route of the extinguishants due to a partial opening. Some example embodiments may necessitate a 180 degree or more rotation to properly rupture the barrier. A 180 degree rotation could be possible through, for example, a dual blade system, where each blade may cut a different portion of a seal of the barrier. Opening protrusions on a dual blade systems may reach an angled plane or ramp after, for example 180 degrees or more of relative rotation of the hemispheres, thereby, for example, rupturing the barrier.

Further, according to some example embodiments, the material comprising the outer surface or housing of the extinguisher may be fire-resistant or fire-retardant. Appropriate materials that might be incorporated into the outer housing surface may include gypsum, nomex, or the like. Additionally, for example, the selected material may not react with the extinguishants. Further, according to some example embodiments, the interior of the example ball may be lined with a material that differs from the exterior (e.g., plastic interior that resists the effects of the extinguishants such as vinegar, but have a nomex exterior that may not melt in the presence of fire).

Having described various aspects and features of some example embodiments in more general terms, the following provides a more detailed description and further support of the features described herein in the context of some example embodiments with reference to the figures. Referring now to FIGS. 1 through 10 which are directed to various different example embodiments.

FIG. 1 shows, according to some example embodiments, a perspective external view of a fire extinguisher apparatus 1 in the form of a handheld fire extinguishing ball. Fire extinguisher apparatus 1 may have a housing that is comprised of an upper housing portion 2 (e.g., first housing portion) and a lower housing portion 18 (e.g., second housing portion). In this regard, the fire extinguisher apparatus 1 may, according to some example embodiments, be spherical or generally spherical and the upper housing portion 2 may be formed as a portion of a sphere (e.g., a first hemispherical portion) and the lower housing portion 18 may also be formed as a portion of a sphere (e.g., a second hemispherical portion).

As described herein, the upper housing portion 2 may be configured to rotate relative to the lower housing portion 18 to activate the fire extinguisher apparatus 1. Arrows 28 may be included to provide guides to a user that would activate the fire extinguisher apparatus 1. To facilitate gripping the upper housing portion 2 or the lower housing portion 18, the fire extinguisher apparatus 1 may include hand grips 6, which are shown as being included only on lower housing portion 18 in FIG. 1, but could be placed elsewhere on the housing. Upper housing portion 2 may include one or more escape holes 5 through which an extinguishing mixture may be expelled in response to activation of the fire extinguisher apparatus 1. For identification purposes, the fire extinguisher apparatus 1 may also include a label 3, which may be a protruding label, that can indicate that the fire extinguisher apparatus 1 is a fire extinguisher.

Figure 2:
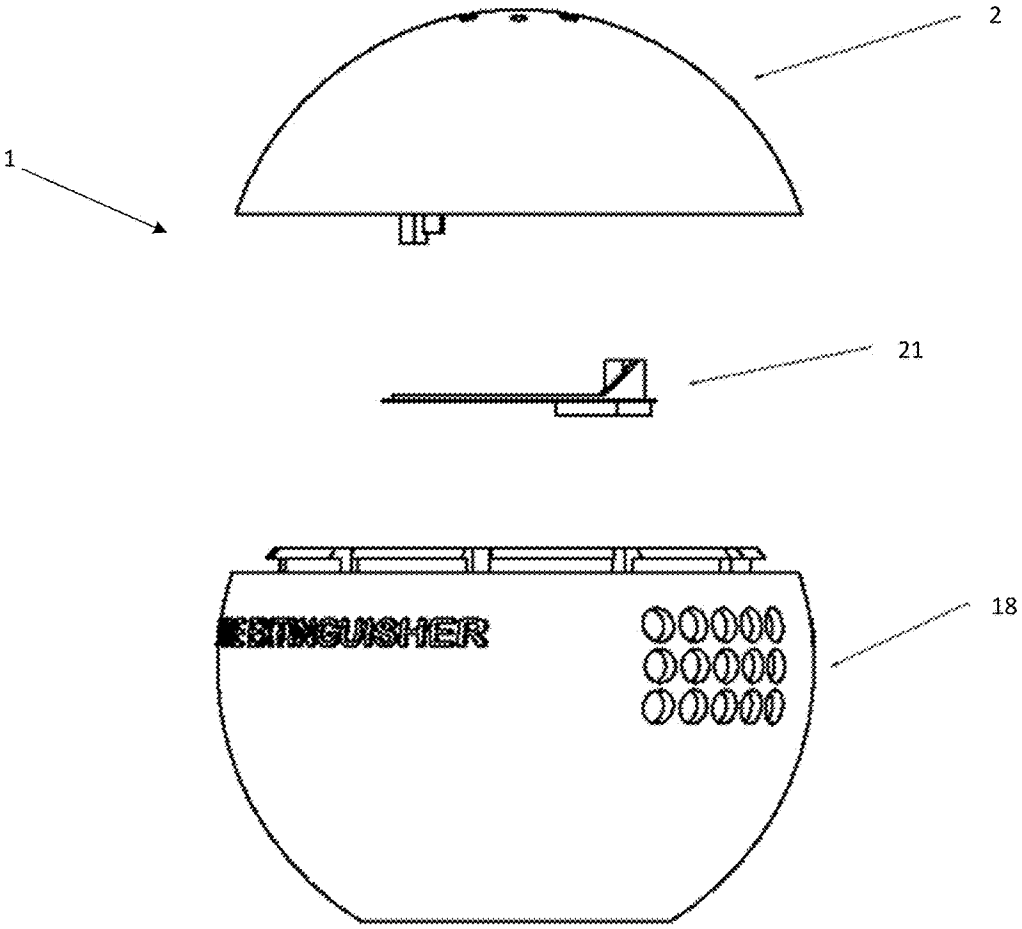
FIG. 2 illustrates an exploded, side view of a fire extinguisher apparatus according to an example embodiment.

FIG. 2 shows an exploded side view of the fire extinguisher apparatus 1. As shown, the fire extinguisher apparatus 1 may be comprised of three components, the upper housing portion 2, a lower housing portion 18, and a barrier 21 disposed between respective compartments in the upper housing portion 2 and the lower housing portion 18.

Figure 3:
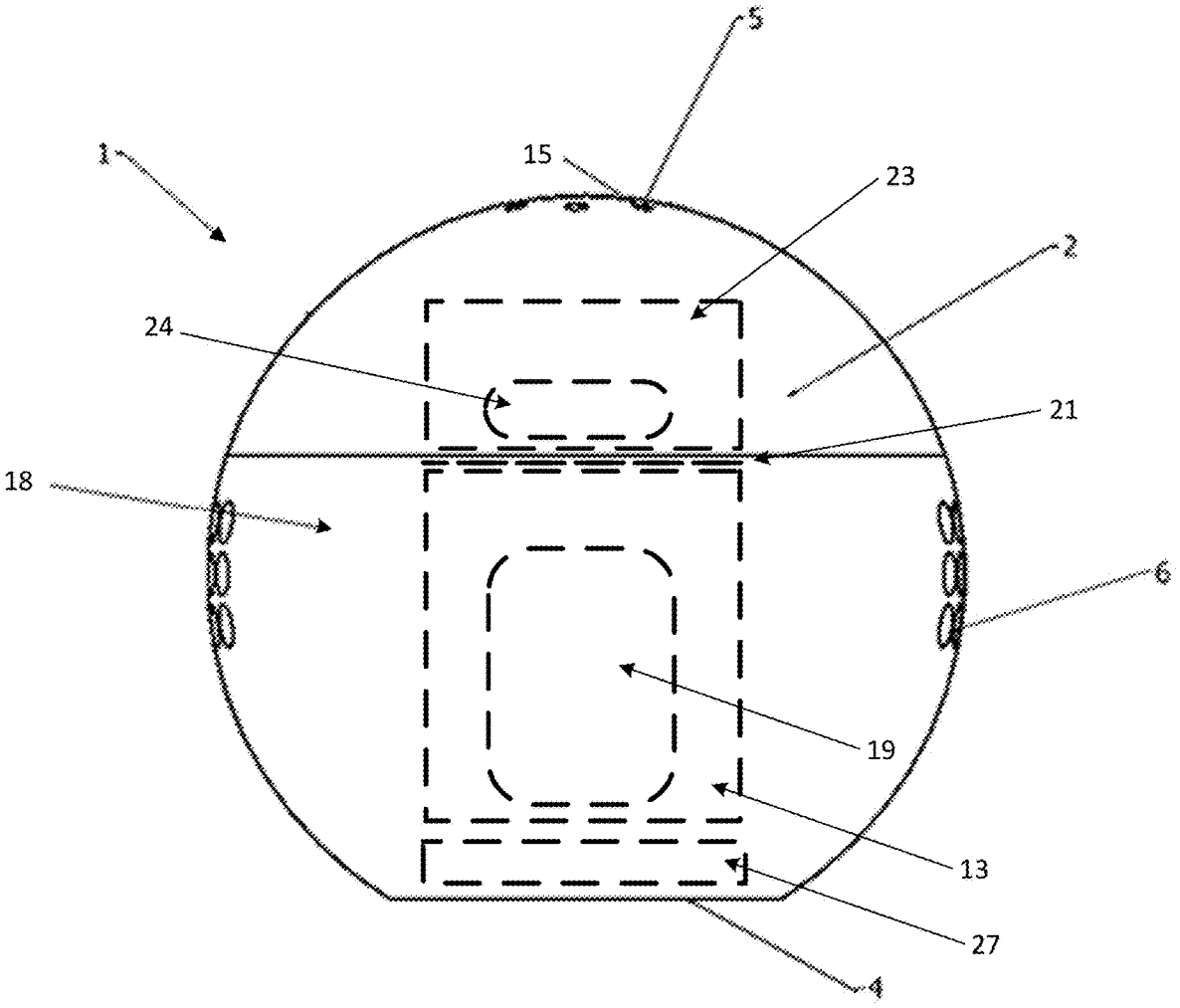
FIG. 3 illustrates an internal side view of a fire extinguisher apparatus according to an example embodiment.

FIG. 3 shows a side view of fire extinguisher apparatus 1 with some internal features and components shown in dotted lines. In this regard, the upper housing portion 2 may be affixed to or house an upper compartment 23 (e.g., a first compartment), within which a first extinguishant agent 24 may be contained. The lower housing portion 18 may be affixed to or house a lower compartment 13 (e.g., a second compartment) within which a second extinguishant agent 19 may be contained. The upper compartment 23 and the lower compartment 13 may be designed to fit specific volumes of first extinguishant agent 24 and the second extinguishant agent 19 respectively, to maximize the amount of fire extinguishing mixture (e.g., foam) created from the reaction between the agents.

According to some example embodiments, since the upper housing portion 2 may be configured to rotate relative to the lower housing portion 18, the upper compartment 23 may also be rotatable relative to the lower compartment 13. Further, according to some example embodiments, the fire extinguisher apparatus 1 may include a barrier 21 disposed between the upper compartment 23 and the lower compartment 13. The barrier 21 may be configured to separate the first extinguishant agent 24 from the second extinguishant agent 19.

According to some example embodiments, the lower housing portion 18 may include a flat base 4, while otherwise being generally spherical in shape. Adjacent to the flat base 4 and possibly affixed to an internal wall, a weight 27 may be disposed. According to some example embodiments, the weight 4 may be placed on a side of the fire extinguisher apparatus 1 opposite the escape holes 5. By positioning the weight 4 in relation to the escape holes 5 in this way, the fire extinguisher apparatus 1 may tend to settle with the escape holes 5 pointing upwards after the fire extinguisher apparatus 1 is thrown or rolled, thereby positioning the escape holes 5 in a position to maximize distribution of an extinguishing mixture that would be expelled out of the escape holes 5. In accordance with another example embodiment, the housing of the fire extinguisher apparatus 1 may be further faceted on its exterior to serve the same purpose as described herein.

Figure 4:
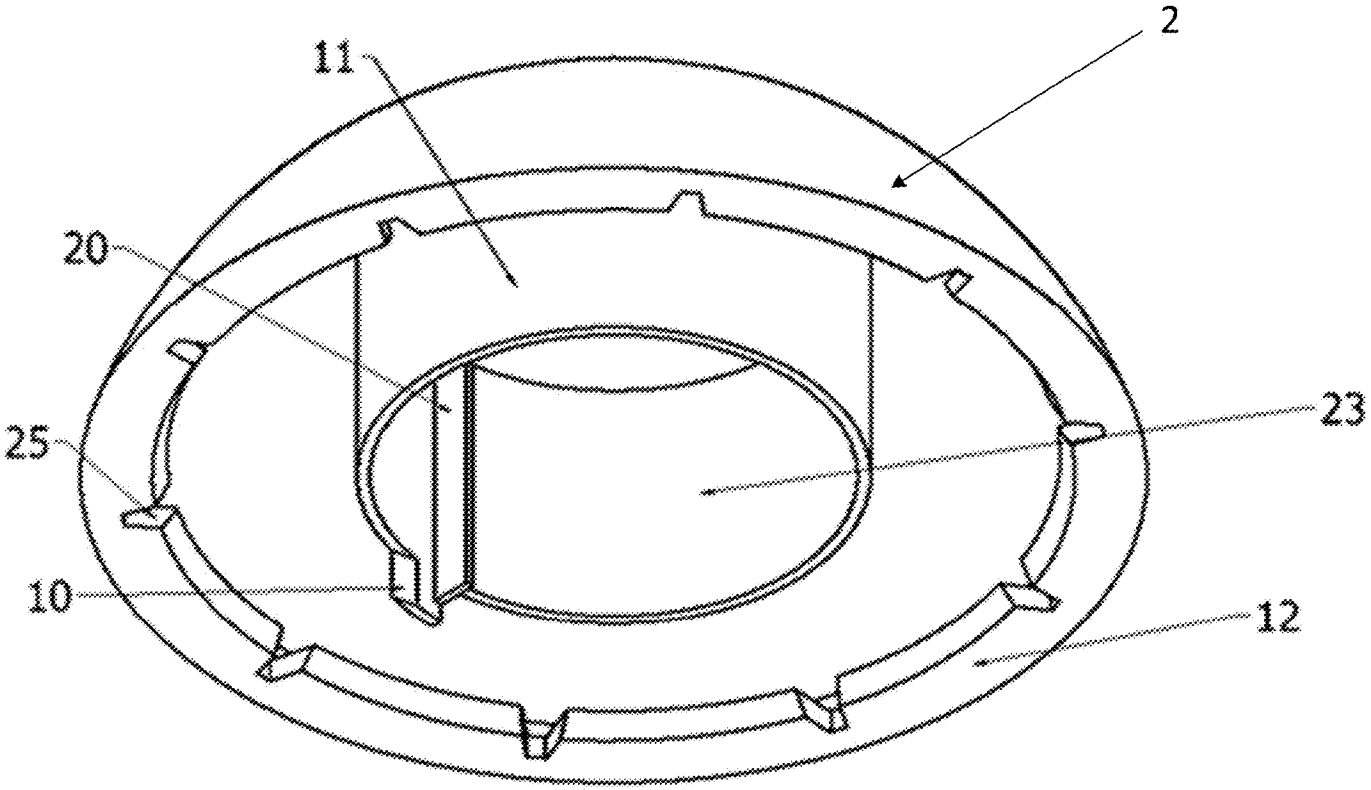
FIG. 4 illustrates an perspective view from below of an upper housing portion of a fire extinguishing apparatus according to an example embodiment.

FIG. 4 shows an interior perspective view of the upper housing portion 2, according to some example embodiments. In this regard, the upper housing portion 2 may include and be affixed to the upper compartment 23, which may be bound on the sides by the upper compartment wall 11 that defines an upper compartment circular opening to the lower compartment 13. The upper housing portion 2 may also include one or more cutouts 12 having cutout gaps 25 disposed between the cutouts 12. The cutouts 12 and cutout gaps 25 may be configured to marry with ridges of the lower housing portion 18 to rotatably affix the upper housing portion 2 to the lower housing portion 18.

According to some example embodiments, the fire extinguisher apparatus 1 may further include a barrier rupture mechanism. The barrier rupture mechanism may be configured to rupture the barrier 21 in response to rotation of the upper compartment 23 relative to the lower compartment 13 to permit the first extinguishant agent 24 to mix with the second extinguishant agent 19 and cause a pressure generating reaction that forms an extinguishant mixture and forces the extinguishant mixture through the escape holes 5 of the housing. The barrier rupture mechanism may be comprised of, for example, a blade 10 and possibly a protrusion 20. The blade 10 and the protrusion 20 may be affixed to the upper compartment wall 11 and may therefore rotate with the rotation of the upper housing portion 2 and the upper compartment 23. As the upper compartment 23 rotates, the blade 10 may move in a circular fashion (as further described herein) to perform a cutting operation along a circumference of a seal of the barrier 21 between the compartments.

According to some example embodiments, barrier rupture mechanisms may take a number of different forms. As described, a movable blade 10 may be one type of barrier rupture mechanism. However, barrier rupture mechanisms may also include, e.g., implementation of a pull tab to rupture the barrier, use of a push down and then twist operation to provide added child or accidental activation protection, or a twist to open a diaphragm between the compartments, such as, for example, a butterfly diaphragm.

Figure 5:
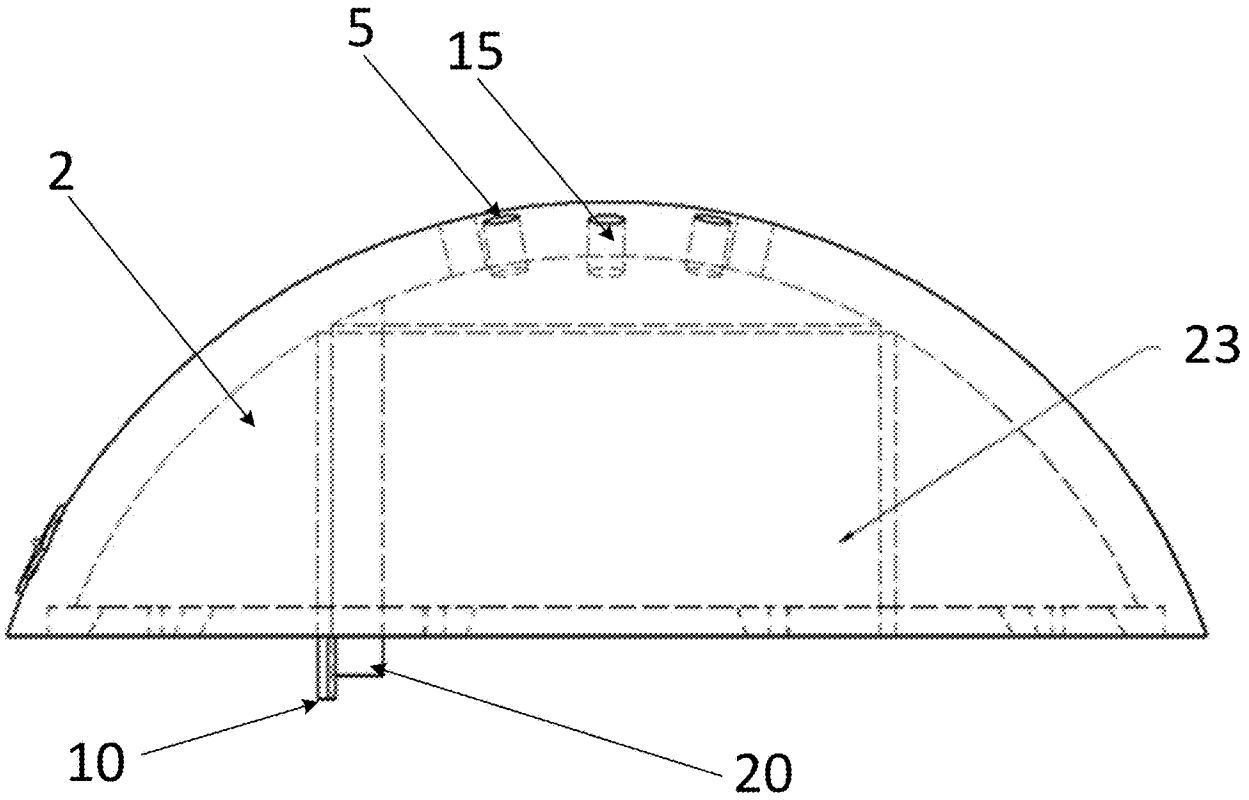
FIG. 5 illustrates an internal side view of an upper housing portion of a fire extinguishing apparatus according to an example embodiment.

FIG. 5 shows another view of the upper housing portion 2 as a side view with internal components and features shown in dotted lines. In this regard, the upper compartment 23 is shown, with the blade 10 and the protrusion 20 affixed thereto. Further, the escape holes 5 are shown, in addition to the hole coverings 15. Hole coverings 15 may be configured to cover the escape holes 5 to maintain the first extinguishant agent 24 within the upper compartment 23. The hole coverings 15, which may be wax, cellophane, or the like, may be configured to break or break in response to a given threshold pressure being applied to the hole coverings 15. In this way, the holes coverings 15 may be configured to breach in response to pressure formed by a reaction between the first extinguishant agent 24 and the second extinguishant agent 19 when the fire extinguisher apparatus 1 is activated. Although not shown, it is contemplated that the escape holes 5 may be replaced by or supplemented with a nozzle that, according to some example embodiments, may include a pressure valve.

Figure 6:
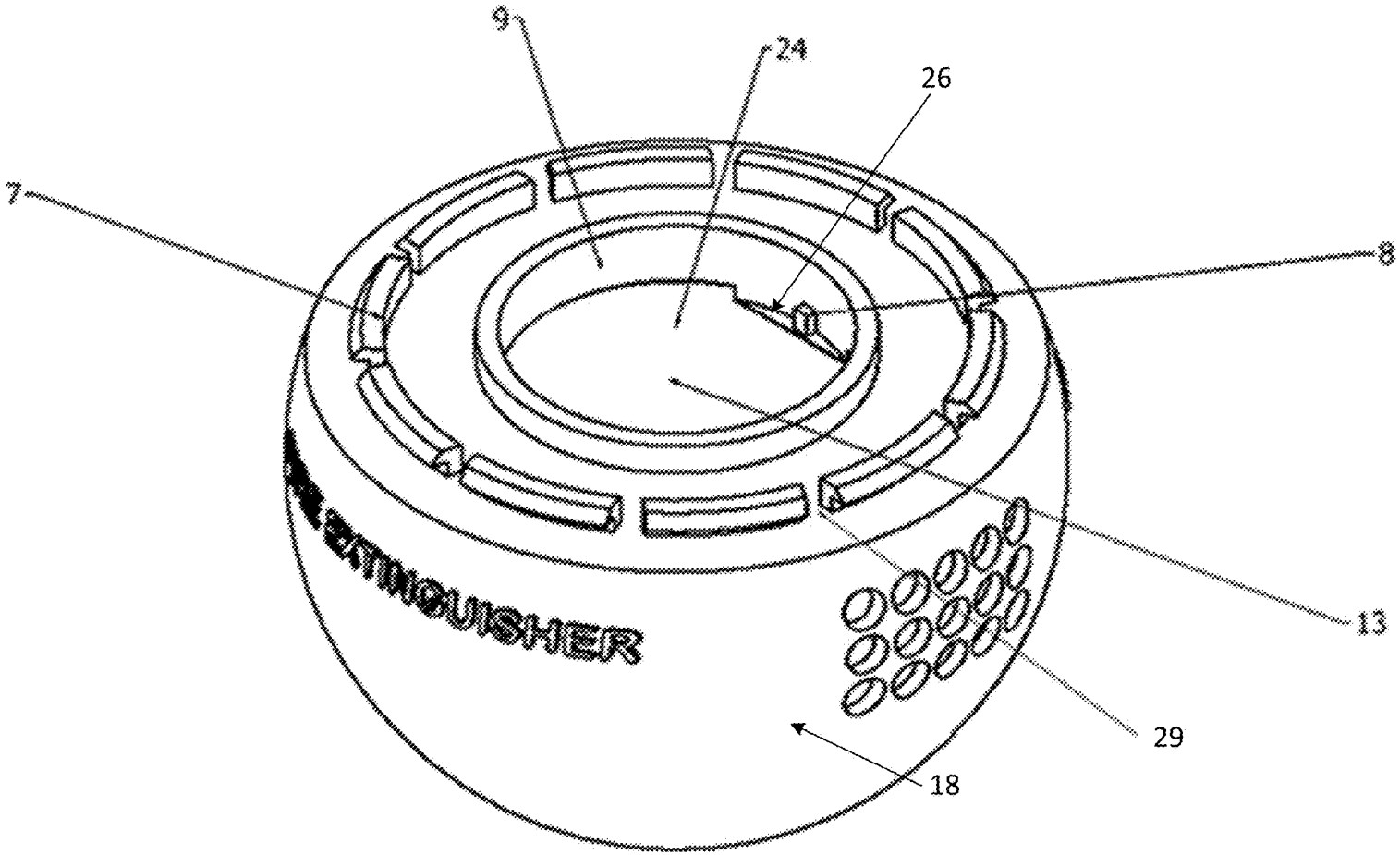
FIG. 6 illustrates a perspective top view of a lower housing portion of a fire extinguisher apparatus according to an example embodiment.

FIG. 6 shows an interior perspective view of the lower housing portion 18, according to some example embodiments. In this regard, the lower housing portion 18 may include, be affixed, or otherwise define the lower compartment 13. The opening of the lower compartment 13 may be extended upwards to form a cylindrical tube portion 9. A stop 8 and a ledge 26 may be disposed on an internal wall of the cylindrical tube portion 9 of the lower compartment 13.

The stop 8 may be placed such that the stop 8 will engage the protrusion 20 of the upper compartment 23 to prevent relative movement between the upper compartment 23 and the lower compartment 13. In this regard, the stop 8 may be configured to engage the protrusion 20 to prevent rotating movement in an incorrect direction (e.g., counterclockwise) or stop 8 may be configured to engage protrusion 20 to prevent further movement in a correct direction if, for example, the upper compartment 23 has rotated through its full travel to operate the barrier rupture mechanism. In this regard, the stop 8 may operate to prevent the blade 10 from cutting past the hinge 22.

According to some example embodiments, the circular opening of the upper compartment 23 may be disposed above the cylindrical tube portion 9 of the lower compartment 13. Further, the barrier 21 may be housed within the cylindrical tube portion 9.

The lower housing portion 18 may also include one or more ridges 7 having ridge gaps 29 disposed between the ridges 7. The ridges 7 may marry, connect, snap into, or the like with the cutouts 12 to affix the upper housing portion 2 to the lower housing portion 18 while still permitting relative rotation between the housing portions. A snap-fit may connect the upper housing portion 2 with the lower housing portion 18 with sufficient strength so as not to fail during activation or mishandling, such as if fire extinguishing apparatus 1 falls from the height of, for example, an average table. Gaps 25 between the cutouts 12 and gaps 29 between the ridges 7 can allow the materials that makes upper housing portion 2 and the lower housing portion 18 to expand briefly so that the two housing portions may snap fit together. The number of cutouts 12 and ridges 7, and the width of the gaps 25, 29 may be dependent upon the material that is used to construct the upper housing portion 2 and the lower housing portion 18.

Figure 7:
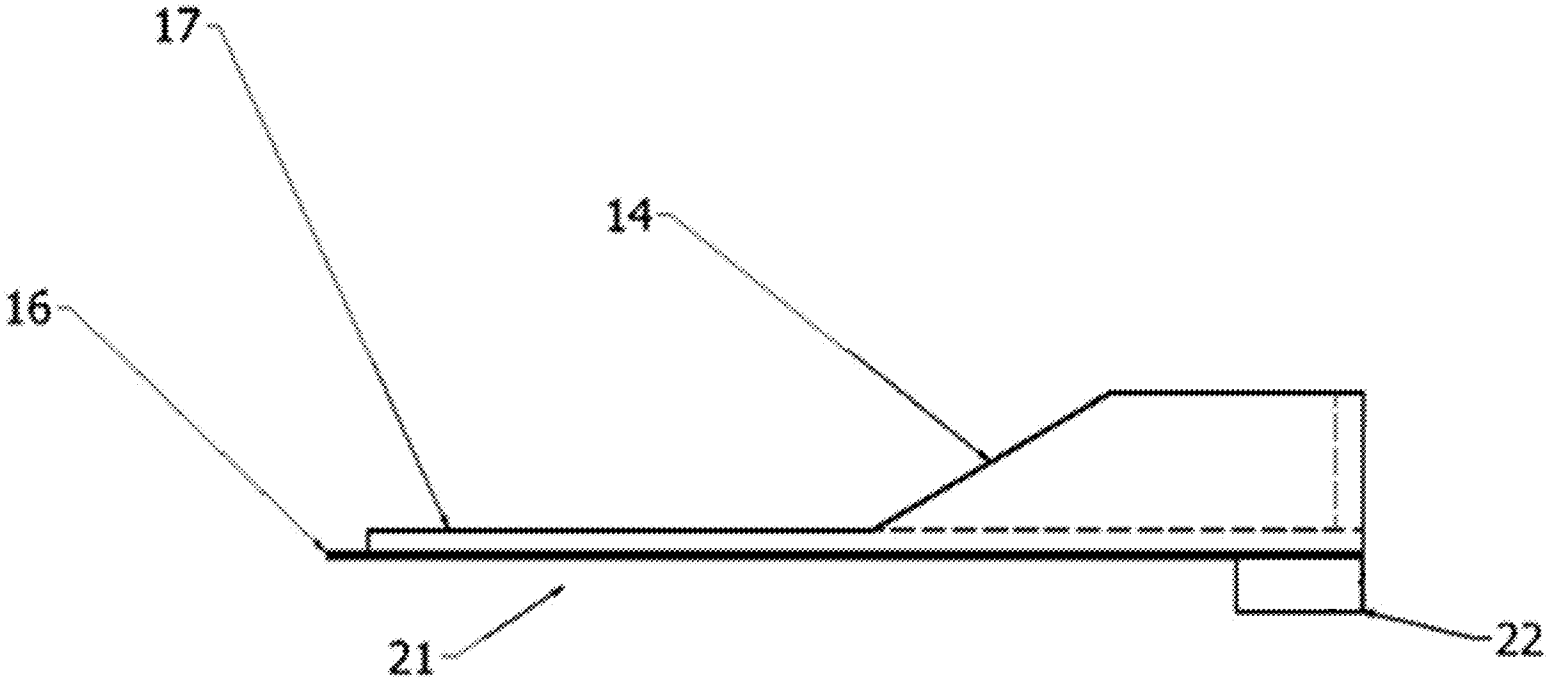
FIG. 7 illustrates a side view of a barrier according to an example embodiment.
Figure 8:
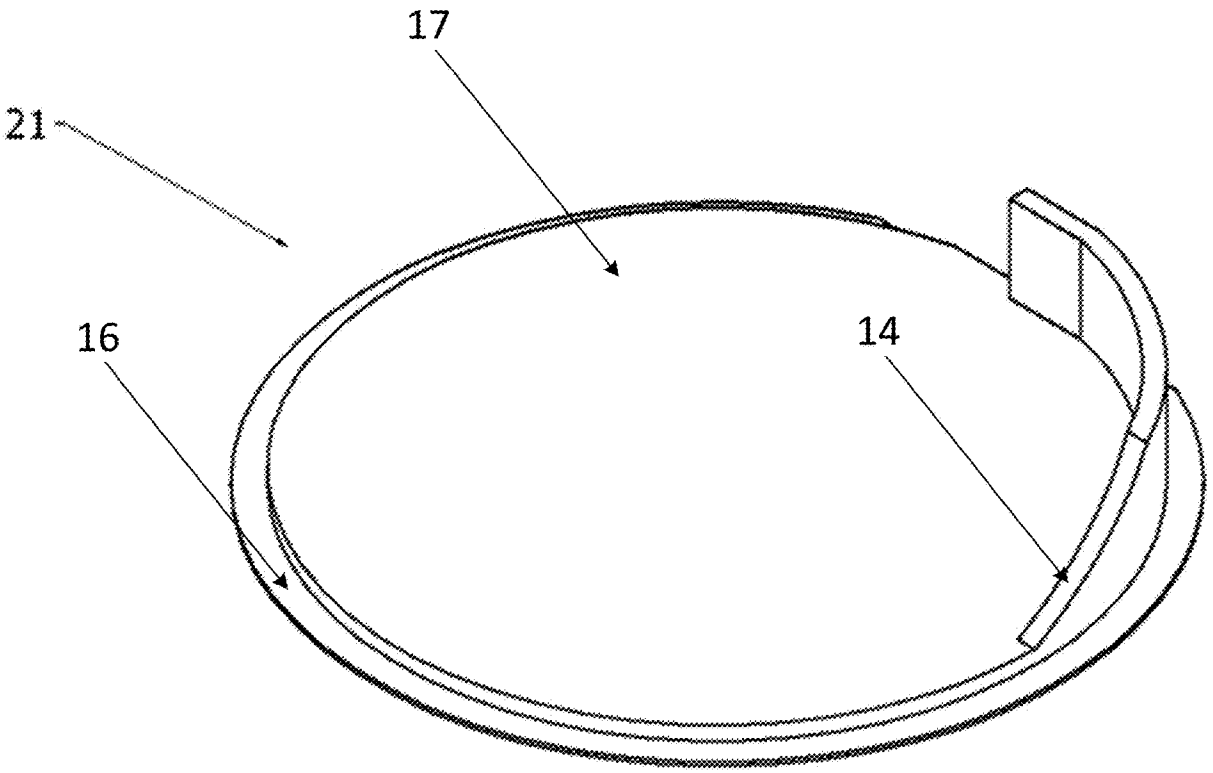
FIG. 8 illustrates a top perspective view of a barrier according to an example embodiment.

FIGS. 7 and 8 show a side view and a perspective top view, respectively, of an example barrier 21 according to some example embodiments. The barrier 21 may comprise a seal 16, a plate 17, a ramp 14, and a hinge 22. In this regard, the barrier 21 may be disposed within the cylindrical tube portion 9 as described herein. The seal 16 may engage the edges of the internal walls of the cylindrical tube portion 9 to form an air or water-tight seal between the upper compartment 23 and the lower compartment 13. The seal 16 may be comprised of a wax, cellophane, shrink wrap, or the like. The seal 16 may be disposed around the edge of the barrier 21, and the blade 10 of the barrier rupture mechanism may be configured to rotate with the upper compartment 23 to cut the seal 16 around the barrier 21. Prior to rotation of the housing portions, the blade 10 may be nested within a slot for the blade 10 between the ramp 14 and the internal wall of the cylindrical tube portion 9 until rotation of the housing portions begin.

Figure 9:
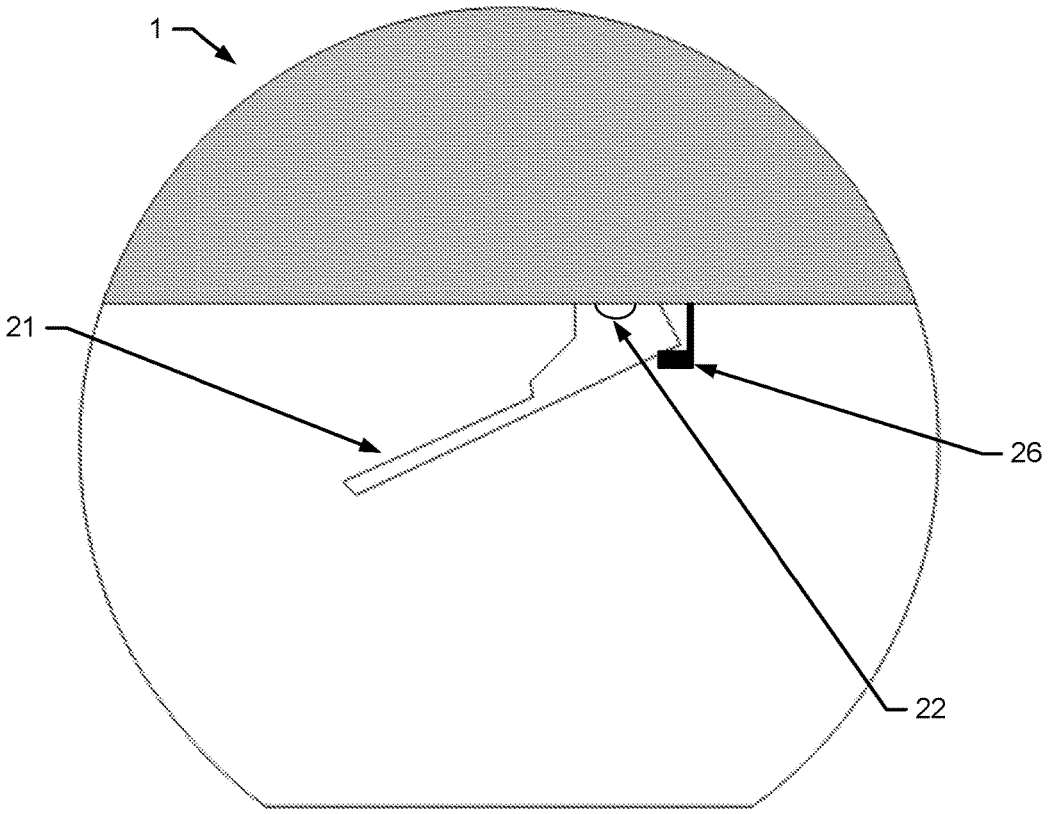
FIG. 9 illustrates a side view of a fire extinguisher apparatus with an open barrier according to an example embodiment.

Further, the protrusion 20 of the barrier rupture mechanism may be configured to rotate with the upper compartment 23 to engage the ramp 14 and force the plate 17 into an increasingly open position as depicted in FIG. 9 between the upper compartment 23 and the lower compartment 13 as the upper compartment 23 rotates relative to the lower compartment 13. In this regard, as the protrusion 20 turns with the upper compartment 23, the plate 17 (which may be a rigid plate) may pivot about the hinge 22 (due to hinge 22 resting on ledge 26) as the upper compartment 23 rotates relative to the lower compartment 13 in response to engagement between the protrusion 20 and the ramp 14.

According to some example embodiments, the ramp 14 is disposed on the plate 17 of the barrier 21 at a position such that a portion of the seal 16 is cut by the blade 10 prior to the protrusion 20 engaging with the ramp 14. According to some example embodiments, more than half of the seal 16 may be cut by the blade 10 prior to the protrusion 20 engaging with the ramp 14.

According to various example embodiments, the extinguishing agents that combine and react in the fire extinguisher apparatus 1 may vary. For example, according to some example embodiments, the first extinguishant agent 24 may be a powder such as sodium bicarbonate (e.g., baking powder), and may rest on the plate 17 of the barrier 21. The second extinguishant agent 19 may be a liquid such as acetic acid (e.g., vinegar). Further, in accordance with other example embodiments, the extinguishing agents may be water and surfactants, water and substances with potassium bicarbonate, or foaming agents (e.g., surfactants and blowing agents) with their chemical counterparts.

Figure 10:
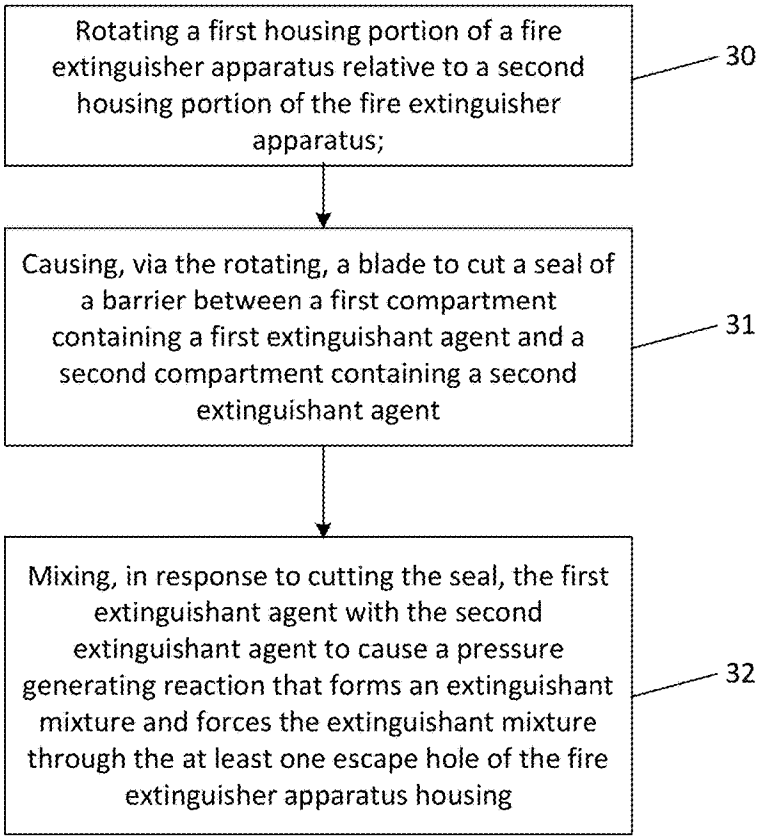
FIG. 10 illustrates a block diagram of an example method of using a fire extinguisher apparatus according to an example embodiment.

FIG. 10 shows a flowchart of an example method in accordance with some example embodiments. In this regard, the example method may include, at 30, rotating a first housing portion (e.g., upper housing portion 2) of a fire extinguisher apparatus (e.g., fire extinguisher apparatus 1) relative to a second housing portion (e.g., lower housing portion 18) of the fire extinguisher apparatus. Further, at 31, the example method may include causing, via the rotating, a blade to cut a seal of a barrier between a first compartment (e.g., upper compartment 23) containing a first extinguishant agent and a second compartment (e.g., lower compartment 13) containing a second extinguishant agent. At 32, the example method may include mixing, in response to cutting the seal, the first extinguishant agent with the second extinguishant agent to cause a pressure generating reaction that forms an extinguishant mixture and forces the extinguishant mixture through the at least one escape hole of the fire extinguisher apparatus housing. According to some example embodiments, the example method may also include causing, in response to the rotating, a protrusion to engage a ramp on a plate of the barrier to force the plate into an increasingly open position between the first compartment and the second compartment as the first compartment rotates relative to the second compartment.

The disclosure in this application is provided in order to enable a person having ordinary skill in the art to practice the inventions. Exemplary embodiments are provided only for illustrative purposes and various modifications will be readily apparent to persons skilled in the art.

The general principles defined herein may be applied to other embodiments and applications without departing from the spirit and scope of the invention. Also, the terminology and phraseology used is for the purpose of describing exemplary embodiments and should not be considered limiting. Thus, the inventions are to be accorded the widest scope encompassing numerous alternatives, modifications and equivalents consistent with the principles and features disclosed.

For the purpose of clarity, details relating to technical material that is known in the technical fields related to the inventions have not been described in detail so as not to unnecessarily obscure the present inventions. For example, the mechanisms and techniques described herein may be altered so as to include the breaking of the barrier in an alternate way (e.g., pulling out something that breaks the barrier). In addition, the ball can be bidirectional (i.e., twist in either direction to activate), and may be reproduced in different sizes and shapes (e.g., a pyramid shaped exterior). Materials can also be altered to be fire resistant (e.g., gypsum, nomex or fire retardant). The chemicals found within the extinguisher apparatus may also be altered so long as they are fire suppressing (e.g., various fire suppressing foams, dry chemical). In addition, the application of such an invention may be broadened to include hospitals, schools, and other institutions of the like.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements or functions, it should be appreciated that different combinations of elements or functions may be provided by alternative embodiments without departing from the scope of the appended claims. In this regard, for example, different combinations of elements or functions than those explicitly described above are also contemplated as may be set forth in some of the appended claims. In cases where advantages, benefits or solutions to problems are described herein, it should be appreciated that such advantages, benefits or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A fire extinguishing apparatus comprising:

a housing comprising at least one escape hole;

a first compartment within the housing containing a first extinguishant agent;

a second compartment within the housing containing a second extinguishant agent, wherein the first compartment is rotatable relative to the second compartment;

a barrier disposed between the first compartment and the second compartment configured to separate the first extinguishant agent from the second extinguishant agent; and a barrier rupture mechanism configured to rupture the barrier in response to rotation of the first compartment relative to the second compartment to permit the first extinguishant agent to mix with the second extinguishant agent and cause a pressure generating reaction that forms an extinguishant mixture and forces the extinguishant mixture through the at least one escape hole of the housing.

2. The fire extinguishing apparatus of claim 1, wherein the barrier comprises a seal, and wherein the barrier rupture mechanism comprises a blade that rotates with the first compartment to cut the seal.

3. The fire extinguishing apparatus of claim 1, wherein the housing is formed of a first spherical portion and a second spherical portion, the first spherical portion being affixed to the first compartment, and the second spherical portion being affixed to the second compartment.

4. The fire extinguishing apparatus of claim 1, wherein the barrier comprises a plate and a ramp and wherein the barrier rupture mechanism includes a protrusion that engages the ramp to force the plate into an increasingly open position between the first compartment and the second compartment as the first compartment rotates relative to the second compartment.

5. The fire extinguisher apparatus of claim 4, wherein the barrier further comprises a hinge, and wherein the plate pivots about the hinge as the first compartment rotates relative to the second compartment in response to engagement between the protrusion and the ramp.

6. The fire extinguisher apparatus of claim 5, wherein the barrier comprises a seal, and wherein the barrier rupture mechanism comprises a blade that rotates with the first compartment to cut the seal, and wherein the ramp is disposed on the plate at a location such that the blade cuts a portion of the seal prior to the protrusion engaging the ramp.

7. The fire extinguisher apparatus of claim 5, wherein the barrier comprises a seal, and wherein the barrier rupture mechanism comprises a blade that rotates with the first compartment to cut the seal, and wherein the ramp is disposed on the plate at a location such that the blade cuts more than half of the seal prior to the protrusion engaging the ramp.

8. The fire extinguisher apparatus of claim 1, wherein the first extinguishant agent is a powder and the second extinguishant agent is a liquid.

9. The fire extinguisher apparatus of claim 8, wherein the powder comprises sodium bicarbonate and the liquid comprises acetic acid.

10. The fire extinguisher apparatus of claim 1, wherein the housing comprises a first housing portion affixed to the first compartment and a second housing portion affixed to the second compartment, and wherein at least of the first or second housing portions includes hand grips configured to facilitate rotating the first housing portion relative to the second housing portion.

11. The fire extinguisher apparatus of claim 1, further comprising a protrusion affixed to the first compartment and a stop affixed to the second compartment, wherein rotation of the first compartment relative to the second compartment is prevented upon engagement between the protrusion and the stop.

12. The fire extinguisher apparatus of claim 1, further comprising at least one hole covering configured to cover the at least one escape hole in the housing, the at least one hole covering being configured to breach in response to pressure formed by the pressure generating reaction.

13. The fire extinguisher apparatus of claim 1, further comprising a weight; wherein the housing comprises a flat base on a side of the housing opposite the at least one escape hole and the weight is disposed within the housing adjacent the flat base.

14. The fire extinguisher apparatus of claim 1, wherein the housing comprises a first housing portion affixed to the first compartment and a second housing portion affixed to the second compartment, and wherein the first housing portion comprises ridges and the second housing portion comprises cutouts; wherein the ridges are configured to snap into the cutouts to affix the first housing portion to the second housing portion and permit rotation between the first housing portion and the second housing portion.

15. The fire extinguisher apparatus of claim 1, wherein the first compartment comprises a cylindrical opening and the second compartment includes a cylindrical tube portion;

and wherein the cylindrical opening of the first compartment is disposed above the cylindrical tube portion and the barrier is disposed within the cylindrical tube portion.

16. The fire extinguisher apparatus of claim 15, wherein the barrier comprises a seal; wherein the barrier rupture mechanism comprises a blade that rotates with the first compartment to cut the seal; and wherein the blade is affixed to the cylindrical opening.

17. A method comprising:

rotating a first housing portion of a fire extinguisher apparatus relative to a second housing portion of the fire extinguisher apparatus;

causing, via the rotating, a blade to cut a seal of a barrier between a first compartment containing a first extinguishant agent and a second compartment containing a second extinguishant agent; and mixing, in response to cutting the seal, the first extinguishant agent with the second extinguishant agent to cause a pressure generating reaction that forms an extinguishant mixture and forces the extinguishant mixture through the at least one escape hole of the fire extinguisher apparatus housing.

18. The method of claim 17 further comprising causing, in response to the rotating, a protrusion to engage a ramp on a plate of the barrier to force the plate into an increasingly open position between the first compartment and the second compartment as the first compartment rotates relative to the second compartment.

19. A fire extinguisher apparatus comprising:

a housing comprising at least one escape hole;

a first compartment within the housing containing a first extinguishant agent;

a second compartment within the housing containing a second extinguishant agent, wherein the first compartment is rotatable relative to the second compartment;

a barrier disposed between the first compartment and the second compartment configured to separate the first extinguishant agent from the second extinguishant agent; and a barrier rupture mechanism configured to rupture the barrier in response to rotation of the first compartment relative to the second compartment to permit the first extinguishant agent to mix with the second extinguishant agent and cause a pressure generating reaction that forms an extinguishant mixture and forces the extinguishant mixture through the at least one escape hole of the housing;

wherein the barrier comprises a seal, and wherein the barrier rupture mechanism comprises a blade that rotates with the first compartment to cut the seal;

wherein the barrier further comprises a plate and a ramp;

wherein the barrier rupture mechanism includes a protrusion that engages the ramp to force the plate into an increasingly open position between the first compartment and the second compartment as the first compartment rotates relative to the second compartment; and wherein the ramp is disposed on the plate at a location such that the blade cuts a portion of the seal prior to the protrusion engaging the ramp.

20. The fire extinguisher apparatus of claim 19, wherein the portion of the seal cut prior to the protrusion engaging the ramp is more than half of the seal.

* * * * *